United States Patent [19]

Nixon

[11] 4,243,986

[45] Jan. 6, 1981

[54] DISPLAY ARRANGEMENTS

[75] Inventor: Ralph D. Nixon, Braintree, England

[73] Assignee: English Electric Valve Company Limited, Chelmsford, England

[21] Appl. No.: 81,386

[22] Filed: Oct. 3, 1979

[30] Foreign Application Priority Data

Oct. 4, 1978 [GB] United Kingdom ..... 39286/78

[51] Int. Cl.[3] ..... G08B 5/36

[52] U.S. Cl. ..... 340/756; 313/497; 313/513; 340/781

[58] Field of Search ..... 340/781, 756; 313/496, 313/497, 513

[56] References Cited

U.S. PATENT DOCUMENTS

| | | | |
|---|---|---|---|
| 3,864,593 | 2/1975 | Kasano | 340/781 X |
| 4,047,073 | 9/1977 | Kishino | 313/497 |
| 4,103,206 | 7/1978 | Eto et al. | 313/497 |
| 4,142,126 | 2/1979 | Dubois | 313/497 |
| 4,149,147 | 4/1979 | Kishino | 340/781 X |
| 4,156,239 | 5/1979 | Hirano et al. | 340/758 |
| 4,162,422 | 7/1979 | Morimoto et al. | 313/496 |
| 4,164,683 | 8/1979 | Nakamura et al. | 313/496 |

FOREIGN PATENT DOCUMENTS

| | | |
|---|---|---|
| 388560 | 3/1933 | United Kingdom . |
| 516769 | 1/1940 | United Kingdom . |
| 908524 | 10/1962 | United Kingdom . |
| 912692 | 12/1962 | United Kingdom . |
| 975251 | 11/1964 | United Kingdom . |
| 1134743 | 11/1968 | United Kingdom . |

*Primary Examiner*—David L. Trafton

*Attorney, Agent, or Firm*—Spencer & Kaye

[57] ABSTRACT

A display arrangement is provided with two opposite display surfaces so that a display can be seen from both directions. The display arrangement consists of an evacuated envelope and fluorescent screens are provided at both display surfaces which are irradiated by a common electron emissive cathode. This enables a display arrangement to be provided which is very thin, but which is capable of providing very bright displays in an economical manner. Segmented mesh electrodes are positioned adjacent to both fluorescent screens so as to selectively control the regions of the screen which fluoresce, and this enables the nature of the display to be readily altered.

6 Claims, 4 Drawing Figures

DISPLAY ARRANGEMENTS

This invention relates to display arrangements which are capable of presenting relatively large bright and readily alterable displays with a moderate power consumption. Although there is a requirement for a double sided display arrangement which is capable of displaying information so that it can be seen from opposite directions it has proved difficult to provide such a display arrangement in a reasonably compact and economical form, whilst at the same time providing a display which is sufficiently bright.

Known forms of double sided display arrangements include large arrays of individually controllable incandescent lamps, but generally it is necessary to provide two separate arrays which are respectively movable from opposite directions. The information presented by such a display can be altered by switching different combinations of lamps to provide the required illuminated pattern, and this requires the switching of the fairly large electric surrents which flow through the incandescent filaments.

According to this invention a display arrangement includes an evacuated envelope having a pair of opposite display surfaces constituted by fluorescent screens, an electron emissive cathode structure positioned between the two fluorescent screens and arranged to irradiate both screens with a flood beam of electrons, and a segmented mesh electrode structure mounted adjacent to each fluorescent screen so as to intercept the electrons from the cathode structure, the different segements of the electrode structure being selectively addressable to control passage of electrons through selected portions thereof.

Preferably the cathode structure consists of a plurality of straight electron emissive wire filaments arranged parallel to each other in a single plane.

Preferably again a pair of elongate deflector plates are positioned one on each side of each electon emissive wire filament so as to direct a flood beam of electrons from the wire filament to respective portions of the segmented mesh electrode structure.

Although it may not always be necessary, it is expected that it will be generally preferable to provide a field mesh between the segmented mesh electrode structure and the cathode structure to form a space charge region from which electrons having a relatively low energy can be drawn through the segmented mesh electrode structure by the application of low voltages applied to it, and subsequently accelerated by a high voltage present on each fluorescent screen.

Figure 1:
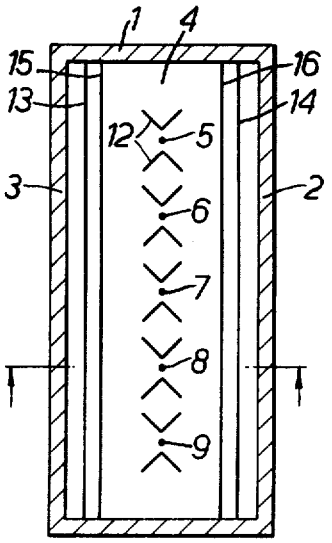
Figure 2:
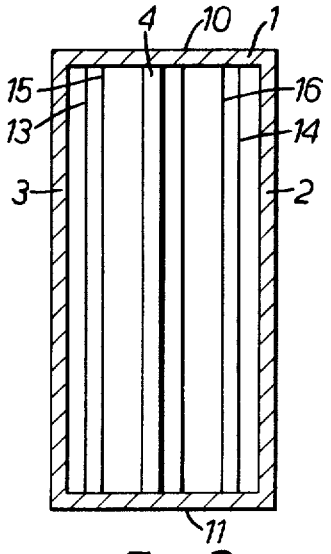
Figure 3:
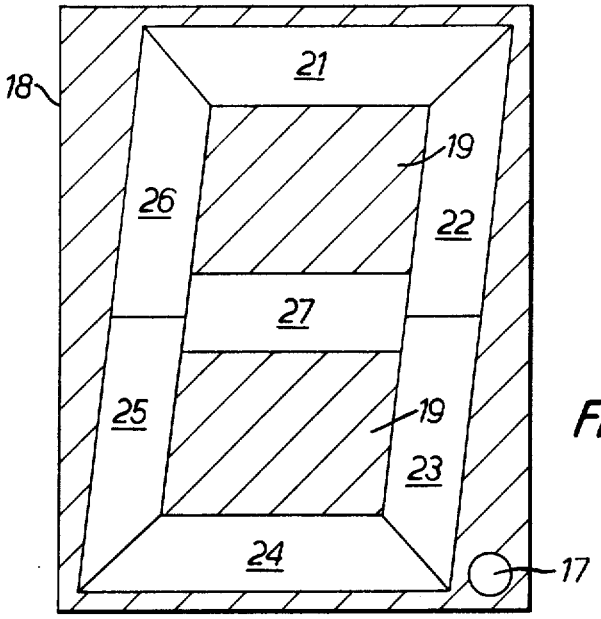
Figure 4:
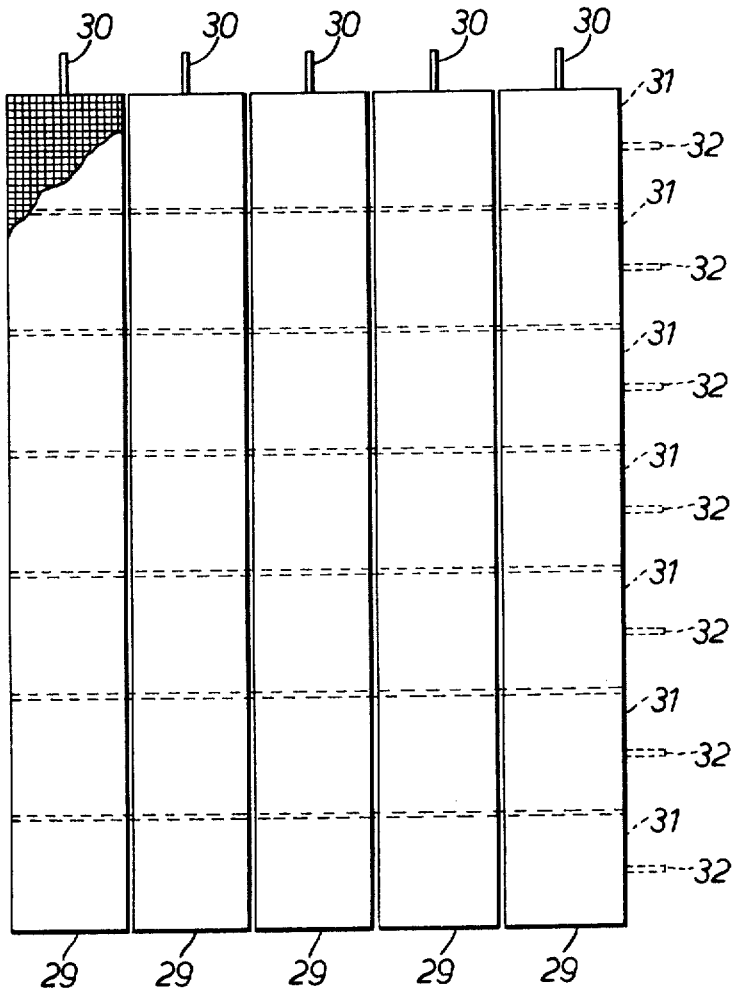

The invention is further described by way of example with reference to the accompanying drawings in which, FIGS. 1 and 2 show sectional views of a display arrangement in accordance with the present invention and FIGS. 3 and 4 show portions thereof in greater detail.

Referring to FIGS. 1 and 2, the display arrangement consists of an evacuated envelope 1 which is rectangular in outline and which is provided with a pair of flat walls 2 and 3 on the inner surface of which is a thin layer of fluorescent material. Positioned centrally within the evacuated envelope 1 is an electron emissive cathode structure referenced generally 4. This structure 4 consists of five elongate filaments 5, 6, 7, 8 and 9, which are mounted under tension so as to extend from opposite end walls 10 and 11 of the evacuated envelope

1. Each filament 5 to 9 is provided with a pair of deflector plates 12 mounted closely adjacent to it so as to control the direction at which electrons are emitted from the cathode structure. Although in FIG. 1 the deflectors 12 are shown as flared plates, this is not essential and instead the deflectors can be in the form of a single flat slotted plate, the plate being provided with as many elongate slots as there are separate filaments so that each filament lies in a slot and is in the plane of the plate. The appropriate angle at which electrons are emitted is then determined by the potentials applied to the device. A pair of segmented mesh electrode structures 13 and 14 are mounted closely adjacent to the fluorescent screens 2 and 3 and the nature of these structures is described in greater detail with reference to FIGS. 3 and 4. Field mesh electrodes 15 and 16 are positioned closely adjacent to each segmented mesh electrode structure 13 and 14 so as to be between it and the cathode structure 4.

When electric current is passed through all filaments 5 to 9 inclusive electrons are emitted and are directed towards the fluorescent screens 2 and 3 by appropriate electric potentials which are present on the deflectors 12. Typically these may be from a few volts negative to a few volts positive with respect to the cathode potential. The actual potential will depend on the actual shape and position of the deflectors 12. A relatively low positive electric potenial about +8 volts with respect to the cathode potential is applied to the field mesh electrodes 15 and 16 so as to form a space charge immediately adjacent each mesh electrode. By the application of suitable potentials to selected regions of the segmented mesh electrode structures 13 and 14, electrons can be drawn from the space charged formed in the vicinity of the field electrons and accelerated towards the fluorescent screens under action of a very high positive potential (typically between +5k volts and +10k volts) applied to the fluorescent screens. By selectively applying the potential to different regions of the segmented mesh electrodes, the nature of the display can be rapidly and efficiently altered. The control currents necessary to achieve display switching are very low indeed and for practical purposes are negligible.

One form that the segmented mesh electrode structures can take is shown in FIG. 3. The electrode structures are drawn as seen from the direction of the fluorescent screens and it can be seen that the plate 18 is provided with an aperture corresponding to a stylised figure of eight, the two island portions 19 being supported by narrow necks not separately shown. Through the apertures, the seven segments 21 to 27 of the segmented mesh electrode 13 or 14 can be seen. The mesh is a fine one (typically 500/inch-200/cm) and the seven segments are electrically insulated from each other, but are provided with separate electrical connections so that each segment is individually addressable.

A circular aperture 17 is provided in the bottom right corner of plate 18 for display applications requiring a decimal point. In such a case a small mesh electrode is positioned behind it in the plane of the mesh electrode.

In operation typically about +10 volts is applied to the field meshes 15 and 16 and about +5k V (with respect to cathode potential) is applied to the fluorescent screens.

The segmented mesh electode structure illustrated in FIG. 3 is clearly suitable only for displaying a relatively small number of different characters which can be represented in a stylised manner. For some applications a more versatile display arrangement may be required and an alternative segmented mesh electrode structure which is capable of producing displays made up from selected points of a dot matrix is shown in FIG. 4. They are drawn as seen from the directions of the fluorescent screen 5 and it can be seen that both consist of segments in the form of parallel stripes. The segmented mesh electrode structure consists of two closely spaced parallel electrodes, each of which consists of five vertical segements 29, termed columns, which are electrically insulated from each other, and each segment is provided with a separate electrical connection point 30. The segmented mesh electrode also includes seven horizontal segments 31 termed rows (which are shown in broken lines for the sake of clarity) which also are electrically insulated from each other and from the segments 29 of the columns. Each segment 31 is provided with an electrical connection point 32.

Each segment consists of an open mesh made up of an electrically conductive portion, which may, for example, be formed by a fine matrix of crossing wires. A portion of this meshlike structure is illustrated at the top left corner of FIG. 4. The open mesh permits electrons to pass readily through the interstices with little physical interruption and the passage of electrons is controlled by the potential present on a particular segment. The mesh is typically about 500 lines/inch - 200/cm. It is only those electrons which pass through both the columns and the rows that produce a bright visible image when they strike the fluorescent screen at the wall 2 or 3. It is not necessary for both the columns and the rows to be made from mesh of the same pitch.

Each segment is provided with a separate electrical lead passing through the envelope of the tube 1 so that each segment is separately addressable.

Each field mesh 15 and 16 is positioned closely adjacent to the segmented mesh electode structure on the flood gun side of it. It is spaced a millimeter or so from the electrode structure, and the column and row meshes are spaced apart by about the same amount. The column and the row meshes are mounted on their own supports and the supporting plates are not illustrated but each consists of an opaque plate having apertures corresponding to the shape of the mesh segments to be supported. The supporting plates in addition to providing mechanical support for the mesh segments also prevents electrons passing between the different adjacent segments which make up a segmented mesh electrode. The segments are conveniently attached to the appropriate supporting plate by means of an electrically insulating adhesive applied around the periphery of the segment. It is, of course, necessary to maintain electrical isolation between the various segments so that each can be addressed individually.

The potentials applied to the cathode 4, the field meshes 15 and 16, and the fluorescent screens are as for the previously described display device. When the connections 30 and 32 to the rows 29 and columns 31 respectively are held at cathode potential (i.e. zero volts) or just a few volts negtive, the fluorescent screen remains dark as no electrons from the flood guns reach it. If, say, a row 29 is held a few volts positive the screen remains dark as long as the columns 31 remains at cathode potential, but if both a row and column are held a few volts positive with respect to the cathode a bright area appears on the screen corresponding to the crossover region of the row and the column.

It will be appreciated that if derived different information or data can be displayed by each fluorescent screen by appropriately controlling the two segmented mesh electrode structures 13 and 14 shown in FIG. 1. The length of the display device can be made sufficiently long so as to accommodate the display of many symbols or characters. In this case the filaments 5 to 9 are as long as necessary and are held under tension to prevent sag. It may be convenient to support the filament at one or two points along their length. A number of segmented mesh electrodes can be mounted side by side along the length of the display device. Where the mesh electrode takes the form shown in FIG. 3 as many separate characters can be displayed as there are mesh electrodes.

In accordance with normal practice the fluorescent material at the screens is provided with a backing electrode, which typically is a very thin evaporated layer of aluminium. These layers of aluminium prevent light generated at one dislay surface from illuminating the opposite display surface and so causing undesirable interference.

The display arrangement can be very thin, typically only 10 amps or less but can possess relatively large display surfaces on which the nature of complex displays can be rapidly altered.

I claim:

1. A display arrangement including an envelope having a pair of opposite display surfaces characterised in that the envelope is evacuated and the display surfaces are constituted by fluorescent screens, the envelope having an electron beam emissive cathode structure positioned between the two fluorescent screens and arranged to irradiate both screens with a flood beam of electrons, and a segmented mesh electrode structure mounted adjacent to each fluorescent screen so as to intercept the electrons from the cathode structure, the different segments of the electrode structure being selectively addressable to control passage of electrons through selected portions thereof.

2. A display arrangement as claimed in claim 1 and wherein the cathode structure consists of a plurality of straight electron emissive wire filaments arranged parallel to each other in a single plane.

3. A display arrangement as claimed in claim 2 and wherein a pair of elongate deflector plates are positioned one on each side of each electron emissive wire filament so as to direct a flood beam of electrons from the wire filament to respective portions of the segmented mesh electrode structure.

4. A display arrangement as claimed in claim 1 and wherein a respective field mesh is located between each segmented mesh electrode and said electron emissive cathode structure.

5. A display arrangement as claimed in claim 1 and wherein the two fluorescent screens are each flat and mutually parallel with the electron emissive cathode structure positioned mid-way between them.

6. A display arrangement as claimed in claim 1 and wherein the segmented mesh electrode structures are such as to allow a plurality of separately controllable characters or symbols to be displayed on each screen.

* * * * *